US006786614B2

(12) United States Patent
Ciarrocchi, Jr.

(10) Patent No.: US 6,786,614 B2
(45) Date of Patent: Sep. 7, 2004

(54) BEVERAGE CONTAINER HOLDER AND LIGHTING ARRANGEMENT HAVING SELECTIVELY ACTIVATED LIGHT SOURCE

(76) Inventor: Peter Ciarrocchi, Jr., 9640 Milnor St., Philadelphia, PA (US) 19114

( * ) Notice: Subject to any disclaimer, the term of this patent is extended or adjusted under 35 U.S.C. 154(b) by 0 days.

(21) Appl. No.: 10/222,065

(22) Filed: Aug. 16, 2002

(65) Prior Publication Data

US 2004/0032730 A1 Feb. 19, 2004

(51) Int. Cl.[7] ..... F21V 33/00
(52) U.S. Cl. ..... 362/101; 362/253; 362/802
(58) Field of Search ..... 362/101, 806, 362/96, 253, 276, 802

(56) References Cited

U.S. PATENT DOCUMENTS 4,344,113 A * 8/1982 Ditto et al. ..... 362/10
4,858,084 A * 8/1989 Sheryll ..... 362/101
4,886,183 A 12/1989 Fleming ..... 220/85
4,922,355 A * 5/1990 Dietz et al. ..... 362/101
5,307,250 A * 4/1994 Pearson ..... 362/101
5,785,407 A 7/1998 Ratcliffe ..... 362/101
6,082,866 A 7/2000 Amedee ..... 362/34
6,092,905 A 7/2000 Koehn ..... 362/101
6,254,247 B1 7/2001 Carson ..... 362/101
6,443,589 B1 * 9/2002 Lee ..... 362/101

* cited by examiner

*Primary Examiner*—Laura K. Tso
(74) *Attorney, Agent, or Firm*—Drinker Biddle & Reath LLP

(57) ABSTRACT

A beverage container holder and lighting arrangement is provided having a base and a wall defining a space for receiving a beverage container. A power source having a first and second conducting means is provided The power source is in electrical communication with a light source. When placed in the beverage container holder and lighting arrangement of the present invention, a beverage container having an appropriate label will complete a circuit and, thereby, cause the light source to be illuminated.

27 Claims, 10 Drawing Sheets

BEVERAGE CONTAINER HOLDER AND LIGHTING ARRANGEMENT HAVING SELECTIVELY ACTIVATED LIGHT SOURCE

FIELD OF INVENTION

The present invention relates to the field of beverage container holders, specifically, to a beverage container holder having a light source activated by contact with particular beverage containers.

BACKGROUND

Beverage manufacturers often seek to advertise and promote their products through the use of promotional devices which attract a customer's attention. Such promotional devices include illuminated signs and signs having moving parts. Beverage manufacturers also provide potential customers with free promotional articles such as t-shirts, pins, beverage holders, bottle openers and the like. Potential customers can take such free promotional articles with them.

As with any promotional or advertising material, it is advantageous if a promotional article attracts attention such as through the use of a light. Such lighted promotional items are particularly appealing in clubs, bars, and restaurants, which usually have dim lighting. Thus, promotional articles such as pins have been equipped with blinking lights to attract the eye.

One problem with existing beverage holders is that any manufacturer's beverage can be placed upon such a promotional coaster or foam beverage sleeve. In addition, if a beverage container holder were constructed with a light source activated by a switch, such beverage container holder could similarly be activated by any manufacturer's beverage container. Thus, there is no incentive for a user of such a coaster or sleeve to continue purchasing a particular brand of beverage.

Accordingly, there is a need for a beverage container which has a light source to attract a potential customer's attention.

There is further the need for a beverage container holder that has a light source which can only be selectively activated by a particular manufacturer's beverage container being placed in contact with the beverage container holder.

There is further the need for a beverage container having a light source that can only be selectively activated by a specially modified beverage container.

SUMMARY OF THE INVENTION

The present invention provides an article that satisfies the need for a beverage container holder that can be adapted to be used in connection with many existing beverage containers, and that has an illuminated component. The present invention provides a truly innovative and effective solution to this need.

The term "beverage container holder" as used herein means any article capable of accepting and holding a beverage container, such as a coaster or beverage sleeve described above.

A beverage container holder having features of the present invention comprises a beverage receiving base with an annular peripheral wall extending upwardly from the base and defining a cavity for receiving a beverage container. An electrical power source is provided. A first conducting means and a second conducting means are provided being spaced apart. The first conducting means is in electrical communication with the power source and a light source. The second conducting means is in electrical communication with the light source. The first conducting means and second conducting means are positioned to contact an appropriate surface of a beverage container placed in the beverage container holder, preferably a metallic label capable of conducting electricity. A light source is provided in electrical communication with the power source, and in electrical communication with the second conducting means. When the first conducting means and the second conducting means contact the appropriate surface of a particular beverage container, a circuit is completed, and the light source is activated.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

DESCRIPTION OF THE DRAWINGS

For the purpose of illustrating the invention, there is shown in the drawings a form which is presently preferred; it being understood, however, that this invention is not limited to the precise arrangements and methodologies shown.

FIG. 4' shows a top plan view of an alternate embodiment of the beverage container holder of the present invention.

DETAILED DESCRIPTION OF THE INVENTION

Figure 1:
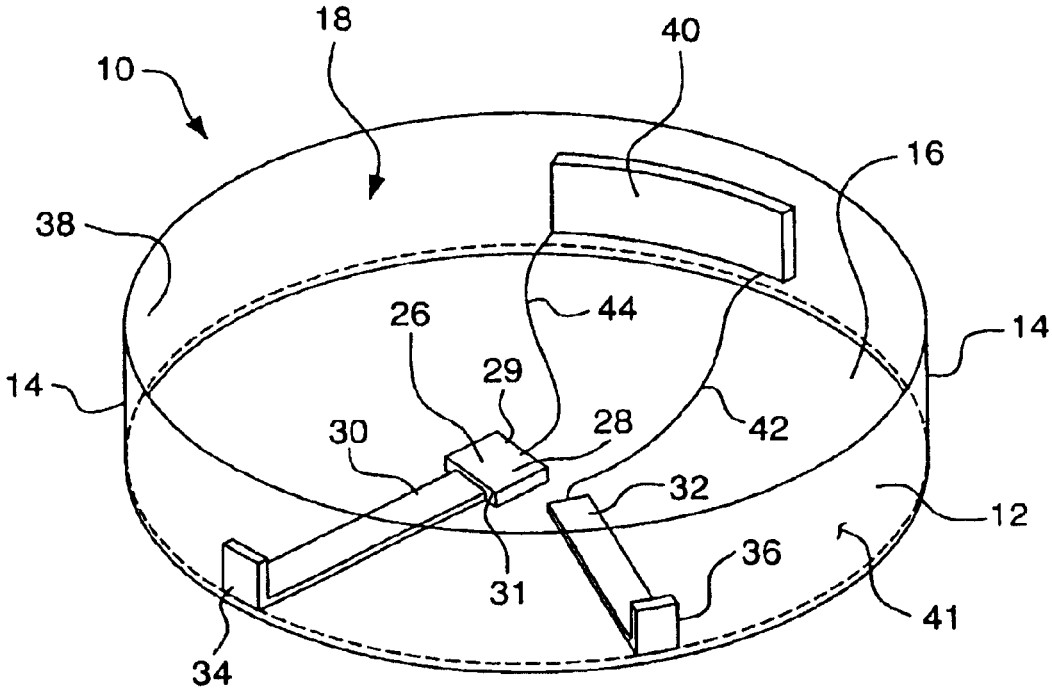
FIG. 1 shows a perspective view of a beverage container holder of the present invention showing the inner construction of the power source, light source and conducting means.
Figure 2:
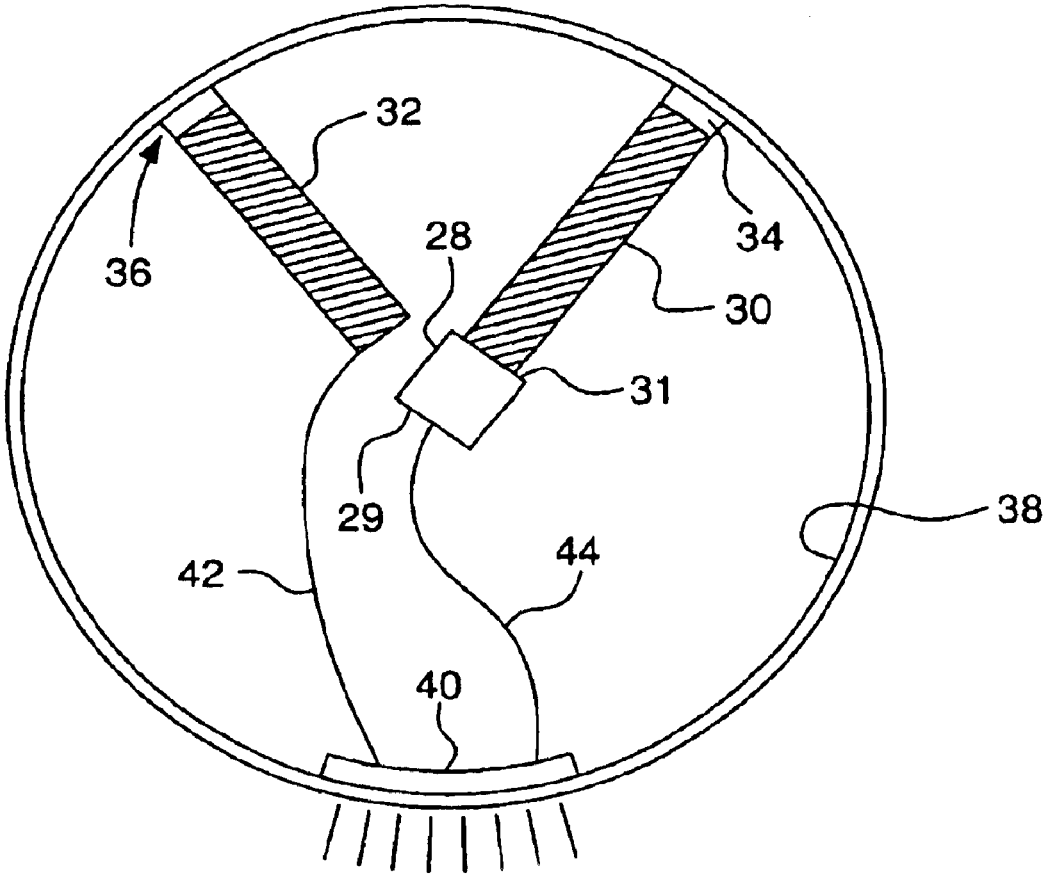
FIG. 2 shows a top plan view of the beverage container holder of the present invention.

Referring to the drawings, wherein like numerals refer to like elements, as shown in FIGS. 1 and 2, the present invention generally comprises a beverage container holder 10 having a beverage receiving base 12 and a peripheral wall 14 extending upward from an upper surface 16 of the base 12. The wall is preferably annular in shape surrounding the periphery of the base, although it is also contemplated that the wall may extend only partway around the base. The wall 14 defines a cavity 18, with an opening opposite the base, sized to receive a beverage container such as a beer bottle or the like.

An electrical power source 26 is provided in, on, or adjacent to the base 12. In the preferred embodiment, the electrical power source 26 is a battery 28 capable of providing power to a light source, for example an LED light or series of LED lights. The battery 28 has a first terminal 29 and a second terminal 31, one being the positive terminal of the battery and the other being the negative terminal of the battery.

A first conducting means 30 and a second conducting means 32 are provided. The conducting means 30, 32 can be formed from of any material which can conduct electricity, such as metal strips, wires, or any similar materials. The first conducting means 30 and second conducting means 32 are provided in electrical communication with the battery 28. In the embodiment shown in FIGS. 1 and 2, the first conducting means 30 is in electrical communication with the second terminal 31, and the second conducting means 32 is in electrical communication with the first terminal 29. The orientation of the battery 28 can be such that the first conducting means 30 is in electrical communication with the positive terminal, and the second conducting means 32 is in electrical communication with the negative terminal, or vice versa. Any arrangement is acceptable, so long as the first conducting means 30 and the second conducting means 32 are in electrical communication with opposite terminals.

The light source 40 is shown in FIGS. 1–4 as being in electrical communication with the second conducting means 32, and also in electrical communication with the first terminal 29. However, it is appreciated that the light source 40 can also be in electrical communication with the first conducting means 30, and therefore in electrical communication with the second terminal 31. Any arrangement where the light source 40 is in electrical communication with one or the other of the conducting means 30, 32 is within the scope of the present invention.

Figure 4:
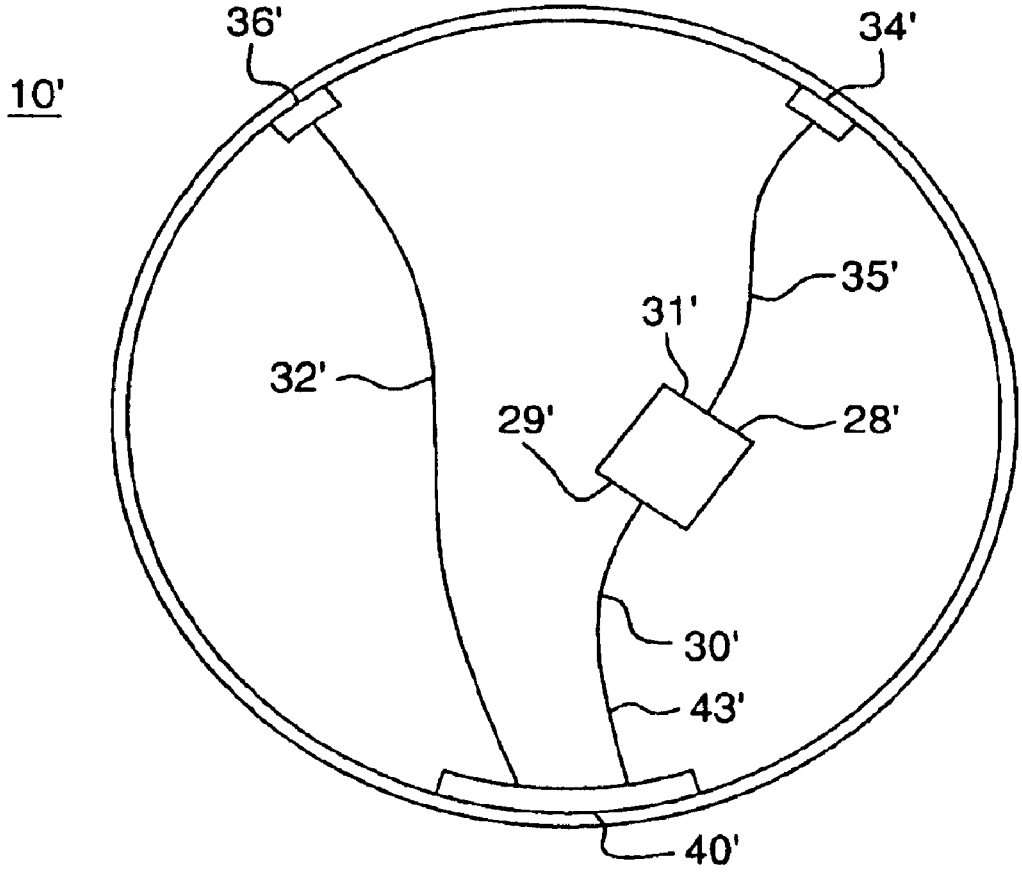
FIG. 4 shows a cross-sectional of an alternate embodiment of the beverage container holder of the present invention.
Figure 4:
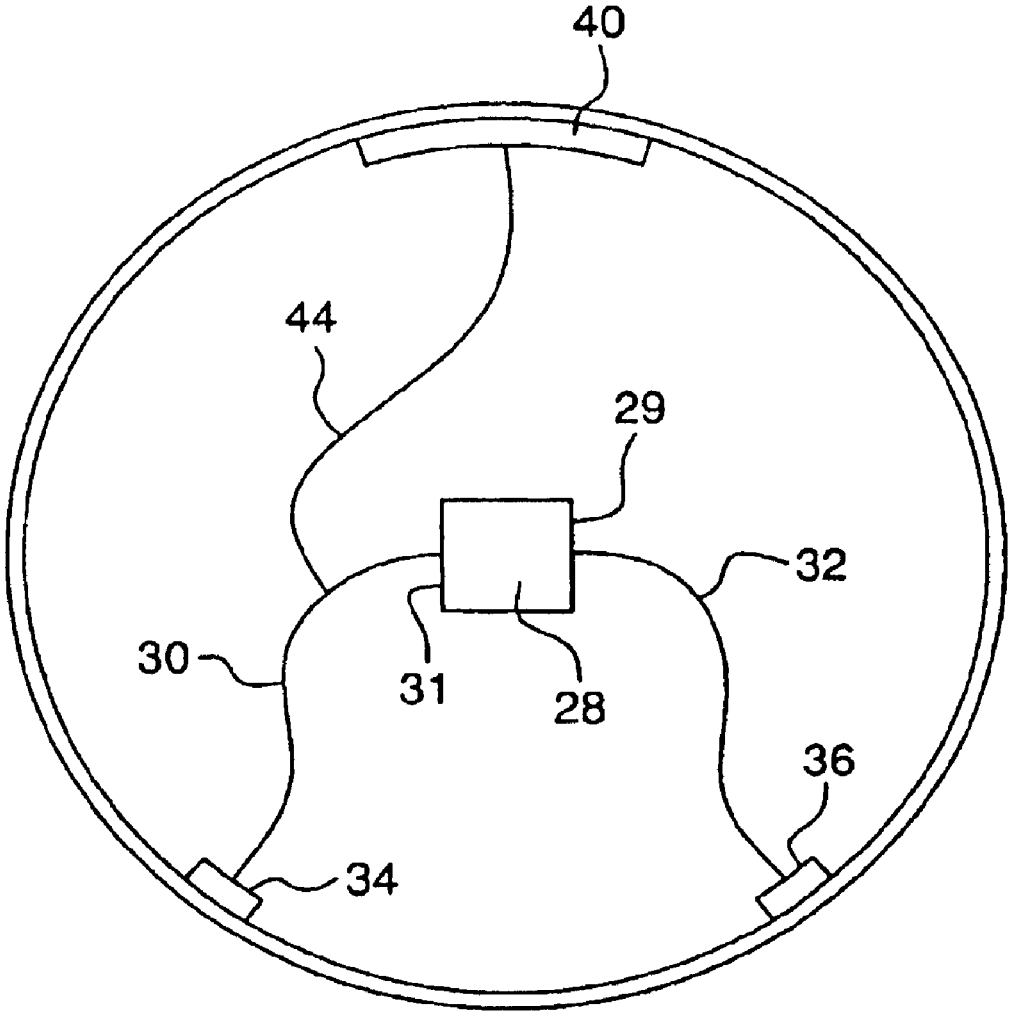

Thus, another embodiment of the present invention is shown in FIG. 4'. The first conducting means 30 is in electrical communication with the second terminal 31 of the battery 28, and also in electrical communication with the light source 40 via wire 44. The second conducting means 32 is in electrical communication with the first terminal 29 of the battery 28. It is appreciated that wire 44 could instead be in electrical communication with first conducting means 30 and the second terminal 31 and be within the scope of the present invention.

Each conducting means 30, 32 has a terminal contact portion 34, 36. The contact portions 34, 36 preferably extend up the inner surface 38 of the wall 14 and are positioned spaced apart from one another. It is appreciated that the contact portions 34, 36 can be formed as separate electrically conducting portions, or can be merely extensions of the first conducting means 30 and a second conducting means 32.

The light source 40 is preferably mounted on the wall 14. The light source 40 may be provided on either the outer surface 41 or the inner surface 38 of the wall. It should be recognized that the light source 40 can be positioned at any selected location along the wall 14 on either the inner or outer surface of the wall 14, or embedded in the wall 14. In a preferred embodiment, the light source 40 comprises at least one LED light. However, several LED lights can be utilized in the present invention, as well as combinations of LED lights, as is well known in the art. In an alternate embodiment of the present invention the light source comprises an electrically powered lighted text window which can have lights arranged in the name of a specific brand of beverage, or can display a fixed or scrolling text message or logo. As shown in FIGS. 1 and 2, the light source 40 may have a first wire 42 in electrical communication with the second conducting means 32. The light source 40 further may have a second wire 44 in electrical communication with the battery 28.

Figure 3:
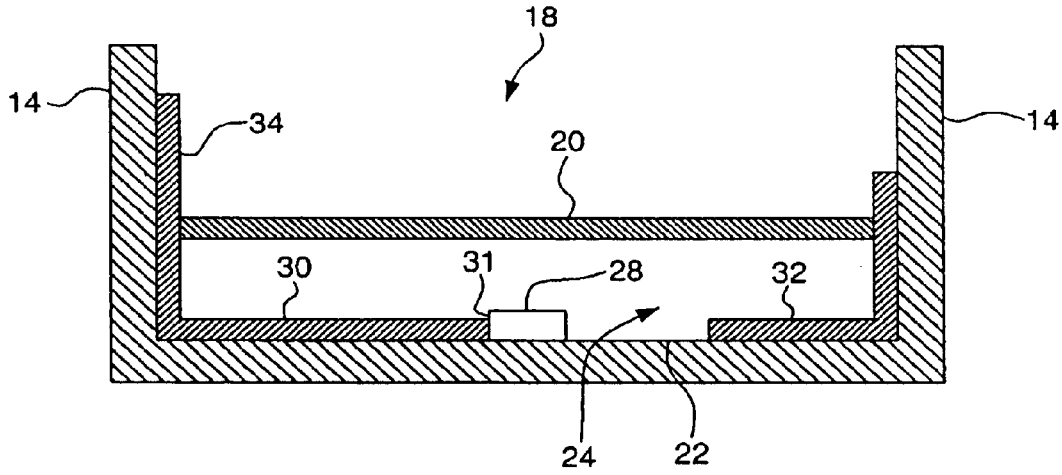
FIG. 3 shows a top plan view of another embodiment of the beverage container holder of the present invention.

In one embodiment shown in FIG. 3, the base 12 may be formed as a upper wall 20 and a lower wall 22 defining a space 24. The power source 28, first conducting means 30, and second conducting means 32 are contained in the space 24. The contact portions 34, 36 extend upwardly along the annular wall 14 and above the upper wall 20. In this arrangement, a beverage container placed on the beverage container holder will rest on the upper wall 20, and not directly on the power source, first conducting means 30, or second conducting means 32.

The conducting means can be formed as unitary electrical conducting means, rather than separate components as previously described. For example, as shown in FIG. 4, a first conducting means 43' is provided with a first portion 30' and a second portion 35'. The first portion 30' is in electrical communication with the light source 40' and a first terminal 29' of the battery 28', and the second portion 35' is in electrical communication with a second terminal 31' of the battery 28'. The first conducting means 43' has a contact portion 34' extending up the inner surface 38' of the wall 14' of the beverage container holder 10' in order to contact a beverage container placed in the beverage container holder 10'. Thus the battery 28' is mounted as part of the first conducting means. A second conducting means 32' is in electrical communication with the light source 40', and has a contact portion 36' extending up the inner surface 38' of the wall 14' of the beverage container holder 10' in order to contact a beverage container placed in the beverage container holder 10'.

Figure 5:
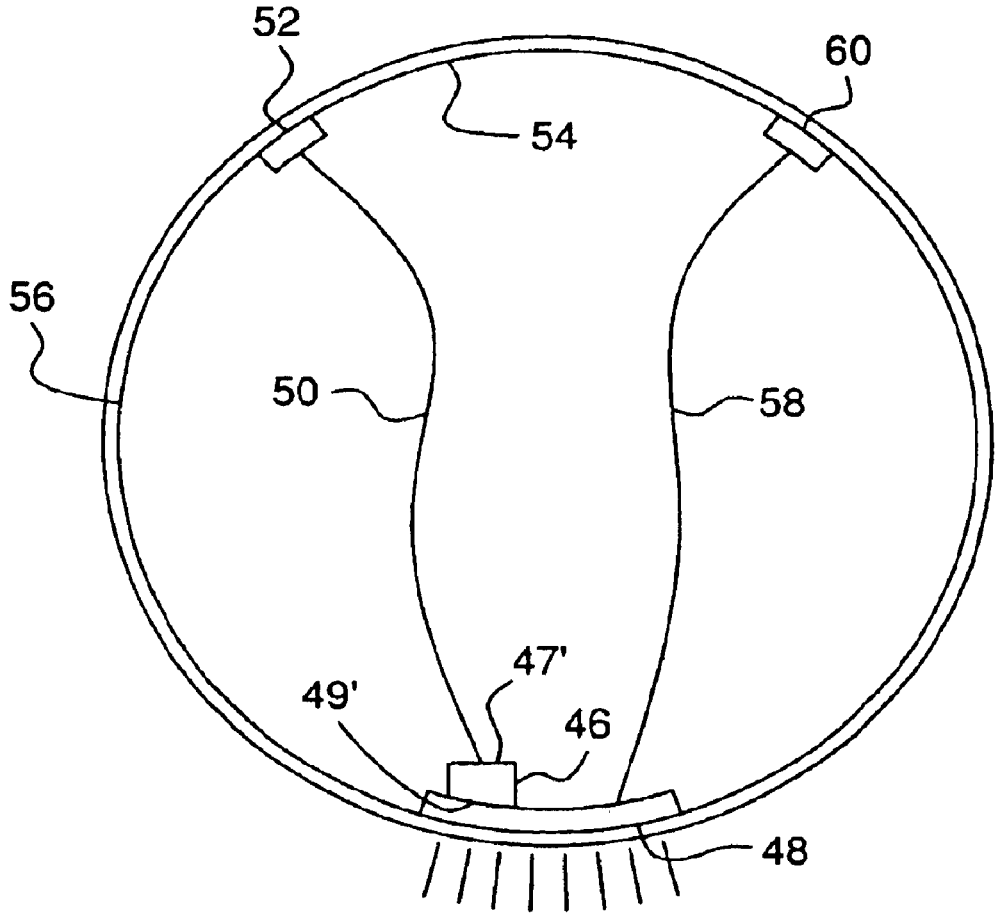
FIG. 5 shows a top plan view of an alternate embodiment of the beverage container holder of the present invention.

It is appreciated that the beverage container holder of the present invention can be arranged in any manner such that an open electrical light circuit is created, the circuit being adapted to be completed by contact with an electrical conductor. It is preferable that the electrical conductor would be either an appropriate beverage container label or coating, or a conducting strip. Thus, as shown in FIG. 5, it is also contemplated that the beverage container holder of the present invention can be formed with the electrical power source 46 directly attached to, formed as part of or embedded in the light source 48. In this embodiment, the conducting means can take the simplest form of wires 50, 58. A first wire 50 is in electrical communication with the power source 46 and has at its end a first contact portion 52 extending up the inner surface 54 of the wall 56. A second wire 58 is in electrical communication with the light source 48, and has at its end a second contact portion 60 extending up the inner surface 54 of the wall 56, with the second contact portion 60 spaced apart from the first contact portion 52.

The spacing of the contact portions is not particularly critical so long as the contacts do not directly touch one another to close the circuit and are sufficiently spaced so as to prevent condensation on the peripheral wall from closing the circuit.

Figure 6:
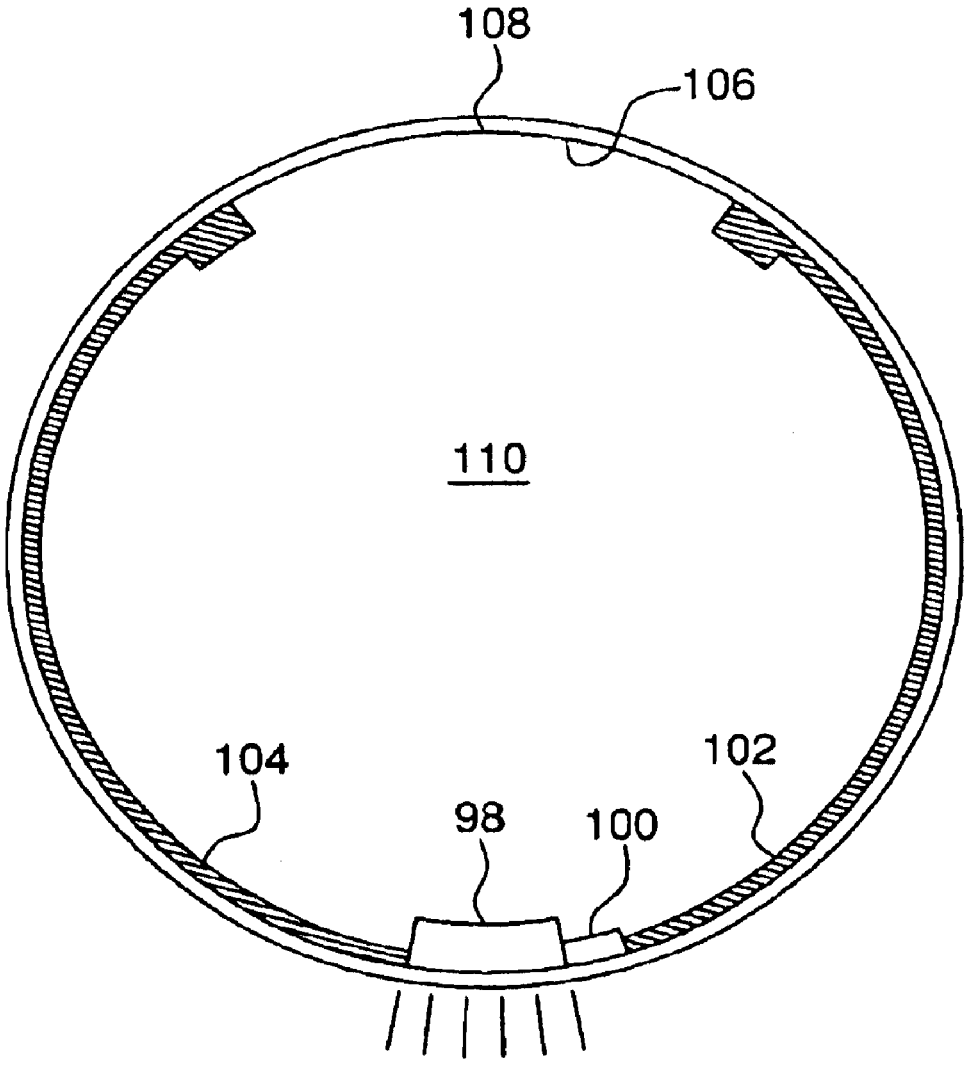
FIG. 6 shows a top plan view of an alternate embodiment of the beverage container holder of the present invention.

In another embodiment of the present invention, shown in FIG. 6, light source 98, power source 100, first conducting means 102, and second conducting means 104 are positioned on the inner surface 106 of the annular wall 108, rather than on the base 110. It is contemplated that any arrangement of the components will satisfy the requirements of the present invention. For example, some or all the components may be located on the peripheral wall (inner or outer surface) or on the base (upper or lower surface).

Figure 7:
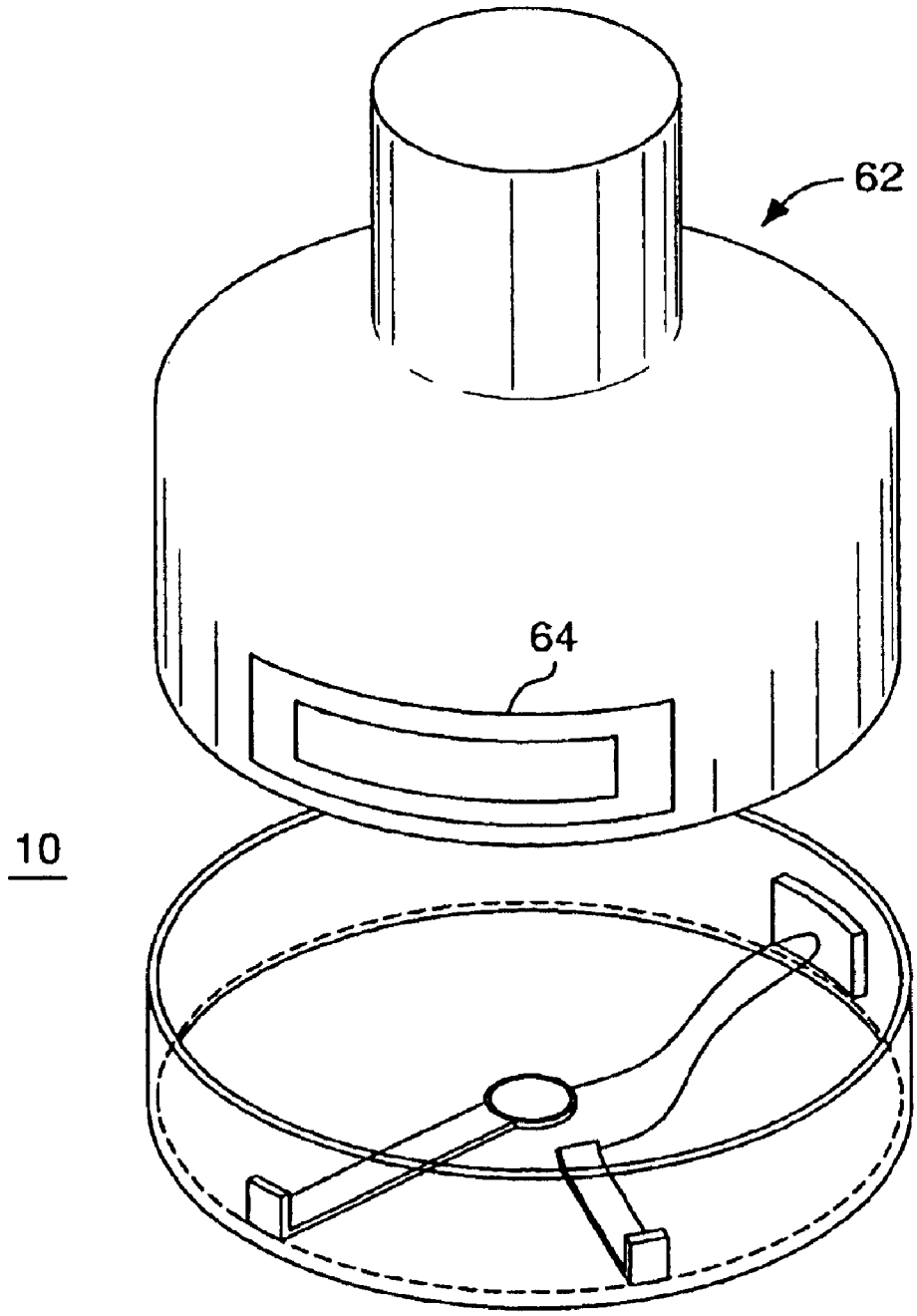
FIG. 7 shows a perspective view of a beverage container aligned for placement into the beverage container of the present invention.
Figure 8:
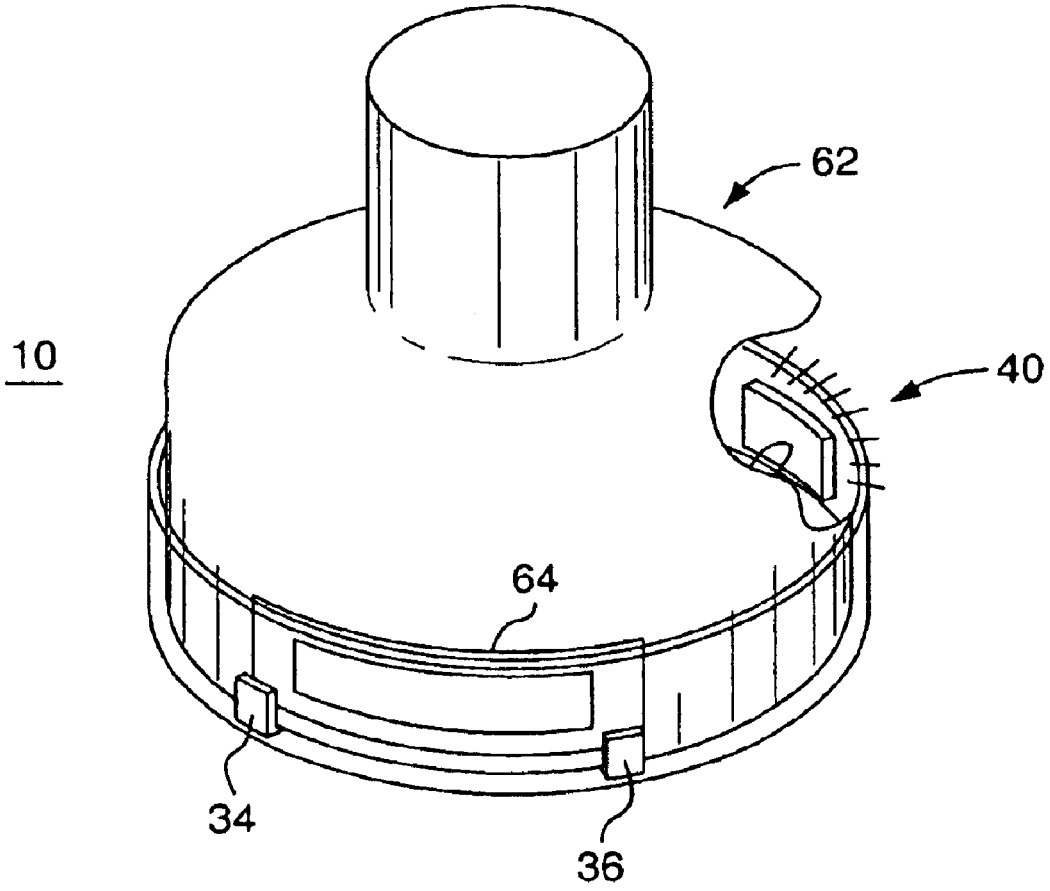
FIG. 8 shows a perspective view of a beverage container placed into the beverage container of the present invention.

As shown in FIGS. 7 and 8, beverage containers 62, such as bottles, are manufactured with activation means such as a metallic or foil label 64 which conducts electricity. As shown in FIG. 7, in use, a beverage container 62 is aligned with the beverage container holder 10. The first contact portion 34 and the second contact portion 36 are positioned so as to contact the label 64. As shown in FIG. 7, the beverage container 62 is accepted by the beverage container holder 10. When the beverage container is positioned in the beverage container holder with the contact portions 34 and 36 aligned with and making contact with the label 64, an electrical circuit is completed, and the light source 40 is activated.

Thus, the light source 40 of the beverage container holder 10 of the present invention can only be activated by beverage containers having the proper activation means capable of conducting electricity, such as having a label of the appropriate size to be aligned with and contact the first and second contact portions 28, 30 simultaneously. In this way, a beverage manufacturer can be assured that only certain bottles, having labels of the appropriate size and formed from electrical conducting materials, will activate the light source of the beverage container holder, and thus advertise or promote only that beverage manufacturer's product. Because users enjoy having promotional devices which produce light and attract attention, a user will be induced to continue using only beverage containers which will activate the light source, resulting in increased sales of a particular beverage manufacturer's product.

Figure 9:
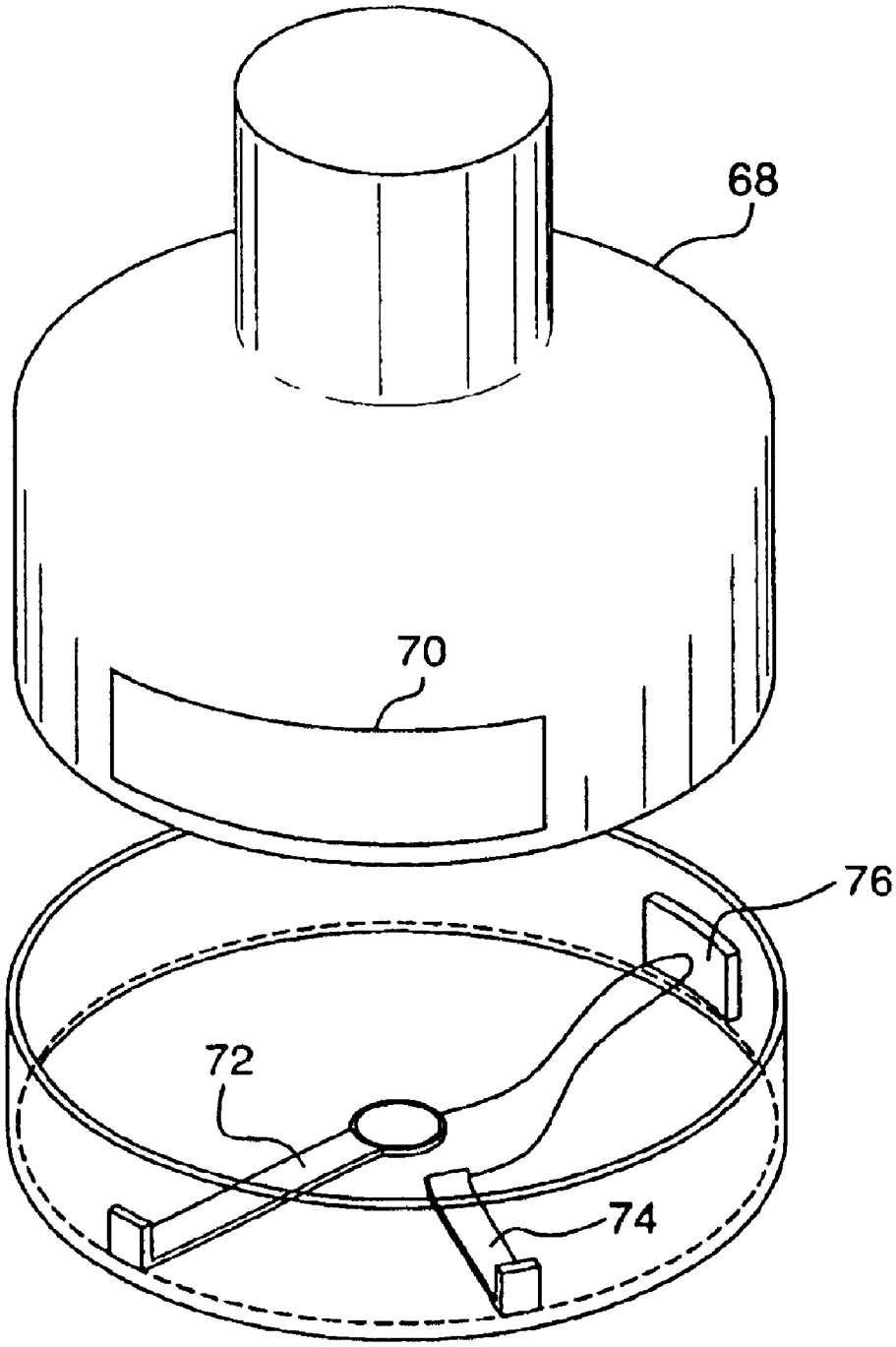
FIG. 9 shows a perspective view of an alternate embodiment of the beverage container holder of the present invention wherein a beverage container is equipped with a conducting strip.

An alternate embodiment, shown in. FIG. 9, can be utilized where a beverage container 68 does not have a label formed from a material capable of conducting electricity. In this embodiment, the activation means is formed as a conducting strip 70. The strip 70 is formed from a material capable of conducting electricity, such as a metallic material. The conducting strip 70 is positioned in the beverage container 68 so that the conducting strip 70 will contact the first conducting means 72 and second conducting means 74 of the beverage container holder 68 simultaneously, thus completing the electric circuit and causing the light source 76 to be activated.

The use of a conducting strip 70 arrangement allows flexibility in that any beverage manufacturer, regardless of label composition, can have its beverage product activate the lighted beverage container holder according of the present invention. The conducting strip 70 can also be formed with an adhesive coating on one side, so that it can be affixed to any beverage container, such as a bottle or glass. The conducting strip 70 can be manufactured to specifications so that it is the proper size to contact the conducting means.

The light source can be configured in various ways to attract attention to the beverage container holder. In one embodiment of the present invention, the light source or a plurality of light sources are provided along the upper surface of the base, or adjacent the base. In this manner, when a beverage container is placed in the beverage container holder of the present invention and activates the light source, the beverage is lit from below, and appears to be illuminated from within.

In another embodiment, a portion of the beverage container holder may be formed of substantially opaque material, for example, a section of the peripheral wall may be opaque. A portion of the opaque section of the wall can be transparent or translucent or include transparent or translucent material, thereby allowing transmission of light. The transparent or translucent portion can be formed, for example, as the name or logo of a beverage manufacturer seeking to promote its product. The light source may be located behind the transparent or translucent portion. When the light source is activated, the transparent or translucent portion of the wall will allow transmission of the light produced by the light source, attracting attention to any indicia.

It is also contemplated that, instead of using a conductive label or strip, a conductive coating may be used. For example, some manufacturers prefer applying paint to their beverage containers as opposed to a label. In such cases, the paint may be formed with conductive properties, such as metallic type paints.

Furthermore, the contact portions need not be located on the peripheral walls as shown in the figures. Instead, the contact portions may be located on the upper surface of the base at locations where the beverage container would contact the upper surface. In this embodiment, the label, strip or coating for completing the circuit would be placed on the bottom of the beverage container. It is contemplated that in this embodiment, a peripheral wall may be eliminated all together, thus allowing the beverage container holder to be similar in form to a coaster with the light source sticking up from the base or, instead, formed in or under the base.

Access may be provided in the base for replacing the battery. Alternately, a solar cell may be included to permit recharging of the battery.

As discussed above, the conducting means may be wires. However, those skilled in the art are well aware of alternate types of devices which can conduct electricity. For example, the conducting means may be copper strips or similar devices used in printed circuit boards.

The present invention may be embodied in other specific forms without departing from the spirit or essential attributes thereof and, accordingly, reference should be made to the appended claims, rather than to the foregoing specification, as indicating the scope of the invention.

What is claimed is:

1. A beverage container holder and lighting arrangement, comprising:

a base;

a wall projecting upward from the base and defining a cavity for receiving a beverage container, the wall having an opening opposite the base for receiving a beverage container;

an electrical power source having a first terminal and a second terminal;

a first conducting means in electrical communication with the second terminal, said first conducting means having a portion located above the base at a position for contacting the side of a beverage container;

a second conducting means in electrical communication with the first terminal, said second conducting means having a portion located above the base at a position for contacting the side of the beverage container; and, at least one light source in electrical communication with either the first conducting means or the second conducting means.

2. A beverage container holder and lighting arrangement, comprising:

a base;

a wall projecting upward from the base and defining a cavity for receiving a beverage container, the wall having an opening opposite the base for receiving a beverage container;

an electrical power source having a first terminal and a second terminal;

a first conducting means in electrical communication with the second terminal;

a second conducting means in electrical communication with the first terminal; and, at least one light source in electrical communication with either the first conducting means or the second conducting means, wherein the first conducting means further includes a contact portion, the wall having an inner surface, and wherein the contact portion extends along a portion of the inner surface of the wall.

3. The beverage container holder and lighting arrangement of claim 2, wherein the second conducting means further includes a contact portion, the contact portion extending along a portion of the inner surface of the wall, the contact portion of the second conducting means being spaced apart from the contact portion of the first conducting means.

4. The beverage container holder and lighting arrangement of claim 3, wherein the location and spacing between the first contact and the second contact is selected to align with one of a label or metallic conducting strip on a particular beverage container.

5. The beverage container holder and lighting arrangement of claim 3, wherein the light source is located within the wall.

6. The beverage container holder and lighting arrangement of claim 3, wherein the light source is located on the outer surface of the wall.

7. The beverage container holder and lighting arrangement of claim 3, wherein the light source is a lighted text window mounted on the wall.

8. The beverage container holder and lighting arrangement of claim 3, wherein the light source is positioned adjacent the base.

9. The beverage container holder and lighting arrangement of claim 3, wherein the power source is a battery.

10. The beverage container holder and lighting arrangement of claim 3, wherein the light source is at least one LED light.

11. The beverage container holder and lighting arrangement of claim 3, further comprising an activation means, the activation means including a material capable of conducting electricity, the activation means sized to contact and be in electrical communication with both the first conducting means and the second conducting means simultaneously.

12. A beverage container holder and lighting arrangement, comprising:

a base:

a wall projecting upward from the base and defining a cavity for receiving a beverage container, the wall having an opening opposite the base for receiving a beverage container;

an electrical power source having a first terminal and a second terminal;

a first conducting means in electrical communication with the second terminal;

a second conducting means in electrical communication with the first terminal; and, at least one light source in electrical communication with either the first conducting means or the second conducting means;

an activation means, the activation means including a material capable of conducting electricity, the activation means sized to contact and be in electrical communication with both the first conducting means and the second conducting means simultaneously, wherein the activation means is a label on a beverage container.

13. The beverage container holder and lighting arrangement of claim 11, wherein the activation means is a conductive strip adapted to be secured to a beverage container.

14. The beverage container holder and lighting arrangement of claim 13, wherein the conductive strip further includes an adhesive thereon for attaching the conducting strip to a beverage container.

15. A beverage container bolder and lighting arrangement, comprising:

a base including an upper wall and a lower wall defining a space;

a wall projecting upward from the base and defining a cavity for receiving a beverage container, the wall having an opening opposite the base for receiving a beverage container, the wall having an inner surface and an outer surface;

an electrical power source located within the space having a first terminal and a second terminal;

a first conducting means located within the space and in electrical communication with the second terminal, the first conducting means having a contact portion extending upwardly along the inner surface of the peripheral wall;

a second conducting means located within the space and in electrical communication with the first terminal, the second conducting means having a contact portion electrically spaced apart from the contact portion of the first conducting means and extending upwardly along the inner surface of the peripheral wall; and, at least one light source in electrical communication with either the first conducting means or the second conducting means.

16. The beverage container holder and lighting arrangement of claim 15, wherein the location and spacing between the first contact portion and the second contact portion is selected to align with one of a label or metallic conducting strip on a particular beverage container.

17. The beverage container holder and lighting arrangement of claim 15, wherein the light source is located within the wall.

18. The beverage container holder and lighting arrangement of claim 15, wherein the light source is located on the outer surface of the wall.

19. The beverage container holder and lighting arrangement of claim 15, wherein the light source is a lighted text window mounted on the wall.

20. The beverage container holder and lighting arrangement of claim 15, wherein the light source is positioned adjacent the base.

21. The beverage container holder and lighting arrangement of claim 15, wherein the power source is a battery.

22. The beverage container holder and lighting arrangement of claim 15, wherein the light source is at least one LED light.

23. The beverage container holder and lighting arrangement of claim 15, further comprising an activation means, the activation means including a material capable of conducting electricity, the activation means sized to contact and be in electrical communication with both the first conducting means and the second conducting means simultaneously.

24. The beverage container holder and lighting arrangement of claim 23, wherein the activation means is a label on a beverage container.

25. The beverage container holder and lighting arrangement of claim 23, wherein the activation means is a conductive strip adapted to be secured to a beverage container.

26. The beverage container holder and lighting arrangement of claim 25, wherein the conductive strip further includes an adhesive for attaching the conducting strip to a beverage container.

27. A beverage container holder and lighting arrangement, comprising:

a base;

an electrical power source having a first terminal and a second terminal;

a first conducting means in electrical communication with the second terminal and having a contact portion located above the base and at a position for contacting a side of a beverage container placed on the base;

a second conducting means having a contact portion located above the base and at a position for contacting a side of a beverage container placed on the base and in electrical communication with the second terminal; and, at least one light source in electrical communication with either the first conducting means or the second conducting means.

* * * * *

UNITED STATES PATENT AND TRADEMARK OFFICE

CERTIFICATE OF CORRECTION

PATENT NO. : 6,786,614 B2
DATED : September 7, 2004
INVENTOR(S) : Peter Ciarrocchi, Jr.

It is certified that error appears in the above-identified patent and that said Letters Patent is hereby corrected as shown below:

Column 7,
Line 59, after the word "base", delete ":" and insert therefor -- ; --.

Signed and Sealed this

Twenty-eighth Day of June, 2005

JON W. DUDAS
*Director of the United States Patent and Trademark Office*